US005253326A

United States Patent [19]

Yong

[11] Patent Number: 5,253,326

[45] Date of Patent: Oct. 12, 1993

[54] PRIORITIZATION METHOD AND DEVICE FOR SPEECH FRAMES CODED BY A LINEAR PREDICTIVE CODER

[75] Inventor: Mei Yong, Canton, Mass.

[73] Assignee: Codex Corporation, Mansfield, Mass.

[21] Appl. No.: 797,881

[22] Filed: Nov. 26, 1991

[51] Int. Cl.[5] ..... G10L 9/14

[52] U.S. Cl. ..... 395/2

[58] Field of Search ..... 381/29-45; 395/2; 370/84, 94.3, 60, 94.1, 80, 81

[56] References Cited

U.S. PATENT DOCUMENTS 4,815,134 3/1989 Picone et al. ..... 381/31

5,091,945 2/1992 Kleijn ..... 381/30

OTHER PUBLICATIONS

"Priority Discarding of Speech in Integrated Packet Networks", by David W. Petr, Luiz A. DaSilva, Jr., and Victor S. Frost, IEEE T Journal on Selected Areas in, Communications, vol. 7, No. 5, Jun. 1989, pp. 644-656.

"Congestion Control for Packet Voice by Selective Packet Discarding", by Nanying Yin, San-Qi Li, and Thomas E. Stern, IEEE Transactions on Communications, vol. 38, No. 5, May 1990, pp. 674-683.

"Code-Excited Linear Prediction (CELP): High-Quality Speech At Very Low Bit Rates", by Manfred R. Schroeder and Bishnu S. Atal, IEEE, 1985, pp. 937-940.

"Distance Measures for Speech Processing", by Augustine H. Gray, Jr., and John D. Markel, IEEE Transactions on Acoustics, Speech, and Signal Processing, vol. ASSP-24, No. 5, Oct. 1976, pp. 380-391.

*Primary Examiner*—Michael R. Fleming
*Assistant Examiner*—Michelle Doerrler
*Attorney, Agent, or Firm*—Darleen J. Stockley

[57] ABSTRACT

A priority assignment method and device are set forth for assigning a priority to a selected speech frame coded by a linear predictive coder based on at least two of: an energy of the speech frame, a log spectral distance between a frame and a frame immediately previous, and a pitch predictor coefficient for the selected speech frame. The invention protects against loss of perceptually important and hard-to-reconstruct speech frames.

22 Claims, 2 Drawing Sheets

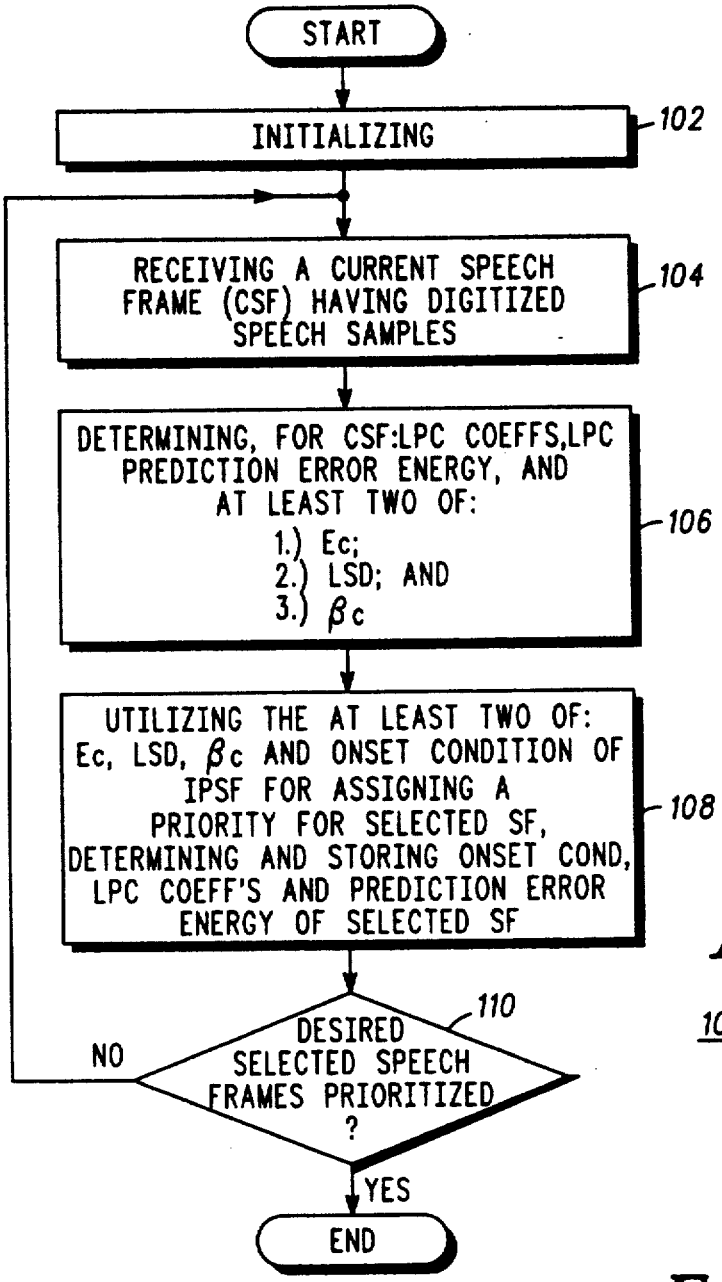
FIG.1
100
FIG.3
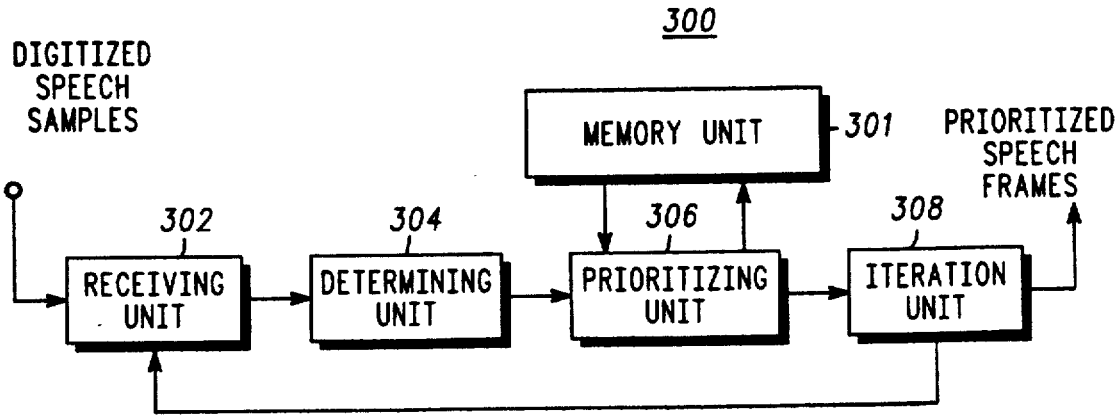

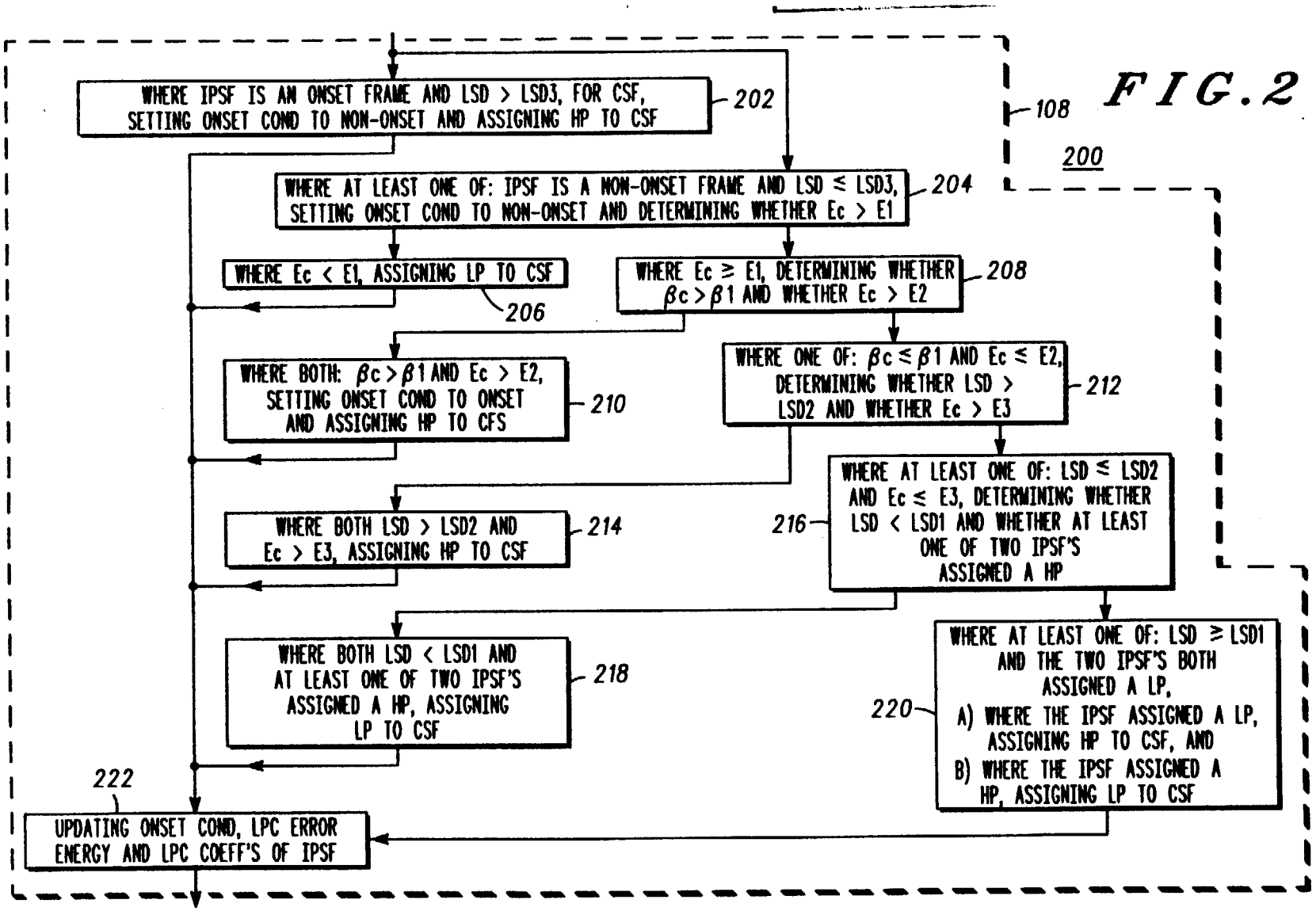
FIG. 2
200
108
202
WHERE IPSF IS AN ONSET FRAME AND LSD > LSD3, FOR CSF, SETTING ONSET COND TO NON-ONSET AND ASSIGNING HP TO CSF
204
WHERE AT LEAST ONE OF: IPSF IS A NON-ONSET FRAME AND LSD ≤ LSD3, SETTING ONSET COND TO NON-ONSET AND DETERMINING WHETHER Ec > E1
206
WHERE Ec < E1, ASSIGNING LP TO CSF
208
WHERE Ec ≥ E1, DETERMINING WHETHER βc > β1 AND WHETHER Ec > E2
210
WHERE BOTH: βc > β1 AND Ec > E2, SETTING ONSET COND TO ONSET AND ASSIGNING HP TO CFS
212
WHERE ONE OF: βc ≤ β1 AND Ec ≤ E2, DETERMINING WHETHER LSD > LSD2 AND WHETHER Ec > E3
214
WHERE BOTH LSD > LSD2 AND Ec > E3, ASSIGNING HP TO CSF
216
WHERE AT LEAST ONE OF: LSD ≤ LSD2 AND Ec ≤ E3, DETERMINING WHETHER LSD < LSD1 AND WHETHER AT LEAST ONE OF TWO IPSF'S ASSIGNED A HP
218
WHERE BOTH LSD < LSD1 AND AT LEAST ONE OF TWO IPSF'S ASSIGNED A HP, ASSIGNING LP TO CSF
220
WHERE AT LEAST ONE OF: LSD ≥ LSD1 AND THE TWO IPSF'S BOTH ASSIGNED A LP,
A) WHERE THE IPSF ASSIGNED A LP, ASSIGNING HP TO CSF, AND
B) WHERE THE IPSF ASSIGNED A HP, ASSIGNING LP TO CSF
222
UPDATING ONSET COND, LPC ERROR ENERGY AND LPC COEFF'S OF IPSF

PRIORITIZATION METHOD AND DEVICE FOR SPEECH FRAMES CODED BY A LINEAR PREDICTIVE CODER

FIELD OF THE INVENTION

The present invention relates generally to prioritizing voice packets in packet-switched communication networks and, more particularly, to prioritizing voice packets such that voice packets that are selected to be perceptually important and/or hard to reconstruct are protected.

BACKGROUND

Human speech is produced by utilizing a vocal tract that has certain normal resonant modes of vibration (formants) that depend largely on an exact position of articulators, such as the tongue, lips, jaw, and velum, that change position during continuous speech, thereby changing the shapes of lung, pharynx, mouth and nasal cavities to facilitate development of different sounds. Perceptually, about the first three formant frequencies for vowels are important in determining sound, but higher formant frequencies are necessary to produce high quality sounds. Three primary modes are typically utilized for exciting the vocal tract: for voiced sounds, broadband semi-periodic breaths of air are passed by the glottis and are utilized to vibrate vocal cords; for unvoiced sounds like s, the vocal tract is constricted to provide turbulent semi-random air flow; and for unvoiced sounds like p, the vocal tract is constricted, then rapidly releases built-up air pressure. A simple digital model of speech production may utilize a source of excitation such as an impulse generator, controlled by a pitch-period signal and a random number generator. The impulse generator produces an impulse (like a breath of air) once every $M_o$ samples, like a pitch period. The reciprocal of this period is the pitch frequency (vocal cord oscillation rate). The random number generator provides an output that is used to simulate the semi-random air turbulence and pressure buildup for unvoiced sources. An alternative excitation model that generally performs better than the simple binary model is the model that produces an excitation signal to the vocal tract system by passing a selected noise-like excitation signal to a time-varying pitch synthesis filter. Parameters of the pitch synthesis filter control a degree of periodicity and a period of the excitation signal. Use of this model does not require explicit classification of a speech frame to voiced or unvoiced. Whether a simple binary source model or an excitation model using the pitch filter is used, such sources are typically applied to a linear, time-varying digital filter to simulate the vocal tract system. Thus, the filter coefficients are utilized to specify the vocal tract as a function of time during continuous speech. For example, on an average, filter coefficients may be varied once every 10 milliseconds to show a new vocal tract configuration. This filter coefficient configuration is usually obtained through linear predictive analysis. Of course, gain control may also be utilized to provide a desired acoustic output level.

As computer engineering and digital signal processing technology has advanced, there has been an increasing demand for cost-efficient transmission of digital information through communication links. To meet this demand, high-speed packet-switched communication networks have been developed. In a packet-switched network, data, voice, and other informational traffic are separately packetized and then transmitted via a same communication channel. To send voice through a packet-switched network, an analog voice input signal is typically digitized and segmented into speech frames that have a fixed length. Each speech frame is analyzed and encoded (compressed) to a set of digital parameters. These sets of parameters are packetized and transmitted via the packet-switched network. At a receiving end of that network, the received packets are first de-packetized, then decoded to the parameters which are subsequently utilized by a speech synthesizer to reproduce an analog voice output.

The packet-switched communication network typically multiplexes different information sources into a single communication channel to maximize bandwidth utilization. However, during peak transmission periods, the network can become congested. When the network is congested, packets are held in queues of switching nodes, causing delays in delivery of packets. A widely used method for relieving network congestion is discarding voice packets. When voice packets containing perceptually important and/or hard to reconstruct speech frames are discarded, there is a loss of clarity in the reconstructed analog voice output. Thus, there is a need for a method and device for prioritizing voice packets such that the voice packets containing perceptually important and/or hard-to-reconstruct speech frames are given a high priority.

SUMMARY OF THE INVENTION

A device and method include prioritization assignment of speech frames coded by a linear predictive speech coder in a packet-switched communication network. The device incorporates units for, and the method includes the steps for, substantially assigning a priority to each of selected speech frames of digitized speech samples generated by a linear predictive speech coder in a packet-switched communication network. The method substantially comprises the steps of: A) initializing a memory unit to desired settings for at least an onset condition for an immediately preceding speech frame (IPSF) and linear predictive coding (LPC) coefficients and energy of linear prediction error for the IPSF; B) receiving at least a first selected current speech frame (CSF) having digitized speech samples; C) determining for the CSF: LPC coefficients, a prediction error energy, and at least two of: an energy ($E_c$); a log spectral distance (LSD) between the CSF and its IPSF; and a pitch predictor coefficient ($\beta_c$); D) utilizing at least two of: $E_c$, LSD, and $\beta_c$, together with the onset condition of the IPSF for assigning a priority for the CSF and for determining an onset condition of the CSF and updating the IPSF onset condition of the memory unit and the IPSF LPC coefficients and prediction error energy of the memory unit; and E) reiterating steps (B) through (D) until desired selected speech frames have been prioritized.

BRIEF DESCRIPTION OF THE DRAWINGS

FIG. 1 sets forth a flow diagram in accordance with the method of the present invention.

FIG. 2 sets forth a flow diagram that further illustrates one embodiment of the step of utilizing an onset condition of an immediately preceding speech frame and at least two of: speech frame energy, log spectral distance between selected consecutive frames, and pitch predictor coefficient for the selected speech frame, for assigning a priority for the selected speech frame.

FIG. 3 sets forth a block diagram of a first embodiment of a device in accordance with the present invention.

DETAILED DESCRIPTION

The method and device of the present invention provide for utilizing not only speech energy as a decision parameter, but also, as selected, pitch predictor coefficient and log spectral distance between adjacent speech frames to overcome prior art shortcomings that allowed loss of voice packets containing speech frames that were perceptually important and/or hard-to-reconstruct. In one embodiment, utilization of pitch predictor coefficient, for example, allows for selection of onset speech frames for a talkspurt. For that talkspurt, frames thereafter are designated non-onset frames. Consideration of log spectral distance between two consecutive speech frames allows for selection of highly transistional frames that are often hard-to-reconstruct. In addition, by utilizing information on priority of previous speech frames, the present invention provides for minimizing the number of consecutive speech frames that are assigned a same priority.

Packet-switched communication networks typically utilize a speech coder for coding speech samples, encrypt coded binary digits where desired, route the voice packets to a source switch that provides for voice packet transfer along a network (such as a local-area network (LAN) or a wide-area network (WAN)) to a sink switch, provide for reassembling packets where desired, incorporate an adaptive delay buffer to accommodate voice packets that have delays within a predetermined acceptable range, provide decryption where desired, decode the received packets, and provide synthesized voice based on the received packets. Clearly, when congestion of voice packet traffic occurs, delays increase. A simple, widely-used prior art method for relieving network congestion is dropping of voice packets. Such a method frequently provides loss of some critical voice packets, resulting in poor resynthesing of voice. The method of the present invention provides for assigning a priority to speech frames generated by a linear predictive speech coder, for example, a CELP (code-excited linear predictive) speech coder, in a packet-switched communication network wherein, for each frame containing a number of digitized speech samples, a priority is assigned to each selected speech frame utilizing a system that protects against loss of perceptually important and/or hard-to-reconstruct speech frames based on at least one of: energy of a selected speech frame, selection of onset speech frames in accordance with a pitch predictor coefficient and speech energy, a log spectral distance between two consecutive speech frames, and comparison of priorities assigned to selected immediately previous speech frames.

The method of the present invention, illustrated in FIG. 1, 100, includes the steps of: (A) initializing a memory unit to desired settings at least an onset condition for an immediately preceding speech frame (IPSF), typically using a first memory location (M1), and linear predictive coding (LPC) coefficients and linear prediction error energy for the IPSF, typically using a second memory location (M2) (102); (B) receiving at least a first selected current speech frame (CSF) having digitized speech samples (104); (C) determining for the CSF: LPC coefficients, a prediction error energy, and at least two of: an energy ($E_c$); a log spectral distance (LSD) between the CSF and its IPSF; and a pitch predictor coefficient ($\beta_c$) (106); (D) utilizing at least two of: $E_c$, LSD, and $\beta_c$, together with the onset condition of the IPSF for assigning a priority for the CSF and for determining an onset condition of the CSF, and updating the IPSF onset condition of the memory unit, the IPSF LPC coefficients and prediction error energy of the memory unit (108); and (E) reiterating steps (B) through (D) until desired selected speech frames have been prioritized (110).

For assigning a priority to a predetermined speech frame (108), typically at least two of:

a set of energy thresholds such as $E_1$, $E_2$, and $E_3$, where $E_1<E_2<E_3$;

a set of log spectral distance thresholds such as $LSD_1$, $LSD_2$, and $LSD_3$, where $LSD_1<LSD_3<LSD_2$; and a pitch predictor coefficient threshold $\beta_1$, where $\beta_1 \geqq 1$; are utilized. Said thresholds are typically precomputed using training data obtained for a selected application. For example, thresholds have been obtained by processing a two minute long dynamic microphone-recorded speech in a quiet environment such that $E_1=32$ dB, $E_2=38$ dB, $E_3=40$ dB, $LSD_1=3.06$ dB, $LSD_2=7.52$ dB, $LSD_3=4.75$ dB, and $\beta_1=1.3$. For some implementations, it may be more desirable to use the energy thresholds that are adapted to background noise.

Assigning a priority for the CSF includes at least one of the following sets of steps, set forth in FIG. 2, 200: (1) where the IPSF is an onset speech frame and the $LSD>LSD_3$, setting an onset condition (ONSET COND) for the current speech frame (CSF) tp NON-ONSET and assigning a high priority (HP) to the CSF (202); (2) where at least one of: the IPSF is a non-onset speech frame and $LSD \leqq LSD_3$, setting the ONSET COND to NON-ONSET, and determining whether $E_c \geqq E1$ (204); (3) where $Ec<E1$, assigning a low priority (LP) to the CSF (206); (4) where $E_c \geqq E_1$, determining whether $\beta c>\beta_1$ and $E_c>E_2$ (208); (5) where both $\beta c>\beta_1$ and $E_c>E_2$, setting the ONSET COND to ONSET and assigning a HP to the CSF (210); (6) where one of: $\beta c \leqq \beta_1$ and $E_c \leqq E_2$, determining whether $LSD>LSD_2$ and whether $E_c>E_3$ (212) and: (a) where both $LSD>LSD_2$ and $E_c>E_3$, assigning a HP to the CSF (214); (b) where at least one of: $LSD \leqq LSD_2$ and $E_c \leqq E_3$, determining whether $LSD<LSD_1$ and whether at least one of two IPSFs was assigned a HP (216); (aa) where both $LSD<LSD_1$ and at least one of two IPSFs was assigned a HP, assigning a LP to the CSF (218); and (bb) where at least one of: $LSD \geqq LSD_1$, and where the two IPSFs were both assigned a LP (220), one of:

where the IPSF was assigned a LP, assigning a HP to the CSF; and where the IPSF was assigned a HP, assigning a LP to the CSF; and updating the IPSF onset condition of the memory unit and the IPSF LPC coefficients and prediction error energy of the memory unit (222).

Where the onset condition of the CSF indicates an onset speech frame, the IPSF onset condition in the memory unit is set to ONSET; and, where the onset condition of the CSF indicates a non-onset speech frame, the IPSF onset condition in the memory unit is set to NON-ONSET.

Further, the onset condition of the CSF is determined both by comparing the pitch prediction coefficient $\beta_c$ of the CSF with the pitch predictor coefficient threshold $\beta_1$ and by comparing the energy $E_c$ with a predetermined threshold $E_2$ such that, typically, where $\beta_c > \beta_1$ and $E_c > E_2$, the CSF is determined to be an onset speech frame and the CSF onset condition is set to ONSET.

Typically, the log spectral distance is determined by determining a mean squared error of cepstral coefficients between the selected current frame and its immediately preceding frame, the cepstral coefficients for a speech frame being determined iteratively from the LPC coefficients and prediction error energy for a corresponding speech frame.

Generally, the pitch predictor coefficient is determined by a desired method of linear predictive analysis.

The present invention is suitable for use in conjunction with linear predictive type speech coders. In linear predictive speech coders, a human vocal tract is generally modeled by a time-varying linear filter that is typically assumed to be an all-pole filter whose z-transform, denoted as $H_s(z)$, is set forth below:

$$H_s(z) = \frac{1}{1 - \sum_{i=1}^{M} a_i z^{-i}},$$

where $a_i$'s are LPC coefficients and M is an order of the filter. This filter, having z-transform $H_s(z)$, is often referred to as a LPC synthesis filter. LPC coefficients for a given speech segment are typically obtained by minimizing the energy of the linear prediction error samples of that segment. Linear prediction error is generally determined by subtracting the predicted sample using previous adjacent samples from a corresponding input signal sample. In addition to a short-term correlation, there is also a long-term correlation between samples that are approximately one pitch period apart in a voiced speech signal. Thus, the predictive coder can also utilize another filter, a pitch synthesis filter, to exploit the long-term redundancy of the speech signal. The pitch synthesis filter typically has a z-transform of the form:

$$H_l(z) = \frac{1}{1 - \beta z^{-T}},$$

where parameter $\beta$ is a pitch predictor coefficient and parameter T is an estimated pitch period. The parameters of the pitch synthesis filter may also be obtained utilizing a desired linear prediction approach. The pitch predictor coefficient $\beta$ tends to be small for unvoiced speech segments, close to one for stationary voiced segments, and greater than one for an onset portion of the speech signal.

In a packet switched communication network, when packets are lost, missing speech segments are typically reconstructed at a receiving end by exploiting a redundancy between a missing frame and its previous frames. For example, a missing speech frame for an unvoiced speech signal is usually reconstructed by simply copying a speech frame received just before the missing speech frame, while a missing speech frame for a voiced speech signal is usually reconstructed by pitch synchronized duplication of previously received speech samples. Since such a reconstruction technique cannot perfectly recover missing speech frames, it is very important to protect against loss of perceptually important speech frames. A known method is to assign a high priority to high energy speech frames and a low priority to low energy speech frames. Although most high energy speech frames are perceptually very important, due to a high correlation between samples of certain speech periods, some high energy speech frames may be very easily reconstructed by using previously received speech frames. Therefore, the present invention performs a priority assignment not only based on speech energy, but also based on a degree of difficulty of reconstructing a speech frame using its previous speech frame. Hard-to-reconstruct speech frames are identified as those that either have a large variation from their preceding speech frames or that are a beginning, i.e., onset, of a talkspurt. Onset speech frames are selected based on both speech energy and pitch predictor coefficient. The highly transitional frames are selected based on the log spectral distance of two adjacent speech frames. The LPC synthesis filter model may be used to characterize a speech spectrum for a corresponding frame.

The device of the present invention (300) for assigning a priority to speech frames generated by a linear predictive speech coder in a packet-switched communication network, has a memory unit (301) typically comprising at least first and second memory locations for storing an onset condition, LPC coefficients, and prediction error energy, respectively, of an immediately preceding speech frame (IPSF) that are initialized to desired settings upon beginning prioritization, and further comprises at least: a receiving unit (302), operably coupled to receive at least a first selected current speech frame (CSF) having digitized speech samples; a determining unit (304), operably coupled to the receiving unit, for determining LPC coefficients and a prediction error energy for the CSF, and for determining, for the CSF, at least two of: an energy ($E_c$); a log spectral distance (LSD) between the CSF and its immediately preceding speech frame (IPSF); and a pitch predictor coefficient ($\beta_c$); a prioritizing unit (306), operably coupled to the iteration unit and to the determining unit, for utilizing at least two of: $E_c$, LSD, and $\beta_c$, together with the onset condition of the IPSF for assigning a priority for the CSF and for determining an onset condition of the CSF and for updating the IPSF onset condition of the memory unit and the IPSF LPC coefficients and prediction error energy of the memory unit; and an iteration unit (308), operably coupled to the prioritizing unit, for, where further desired speech frames are desired to be prioritized, recycling to the receiving unit.

In the device of the present invention, the prioritizing unit (306) for assigning a priority to a predetermined speech frame, typically further includes a threshold utilization unit for utilizing at least two of:

a set of energy thresholds such as $E_1$, $E_2$, and $E_3$, where $E_1 < E_2 < E_3$;

a set of log spectral distance thresholds such as $LSD_1$, $LSD_2$, and $LSD_3$, where $LSD_1 < LSD_3 < LSD_2$; and a pitch predictor coefficient threshold $\beta_1$, where $\beta_1 \geqq 1$; as set forth more fully above.

Further, the prioritization unit typically provides for determining a CSF priority as set out more fully above in the description of the method of the invention. In addition, the prioritization unit provides for updating the IPSF LPC coefficients and the LPC prediction error energy of the memory unit using at least the linear predictive (LPC) coefficients of the CSF, and for one of:

where the onset condition of the CSF indicates an onset speech frame, updating the IPSF onset condition of the memory unit to ONSET; and where the onset condition of the CSF indicates a non-onset speech frame, updating the IPSF onset condition of the memory unit to NON-ONSET.

The prioritization unit typically includes at least one of: an onset condition determining unit, operably coupled to receive $E_c$, $E_2$, $\beta_c$, and $\beta_1$, for determining the onset condition of the CSF by both comparing the pitch prediction coefficient $\beta_c$ of the CSF with the pitch predictor coefficient threshold $\beta_1$ and by comparing the energy $E_c$ with a predetermined threshold $E_2$ such that, typically, where $\beta_c > \beta_1$ and $E_c > E_2$, the CSF is determined to be an onset speech frame and the CSF onset condition is set to ONSET; a log spectral distance determining unit, operably coupled to receive the LPC coefficients and prediction error energy for the CSF, for substantially determining a mean squared error of cepstral coefficients between the selected current frame and its immediately preceding frame, the cepstral coefficients for a speech frame being determined iteratively from the LPC coefficients and prediction error energy; and a pitch predictor coefficient determining unit, operably coupled to receive the digitized speech samples, for determining the pitch predictor coefficient by a desired method of linear predictive analysis.

I claim:

1. A method for assigning a priority to each of selected speech frames generated by a linear predictive speech coder in a packet-switched communication network, comprising the steps of:

A) initializing a memory unit to desired settings for at least an onset condition for an immediately preceding speech frame (IPSF) and linear predictive coding (LPC) coefficients and prediction error energy for the IPSF;

B) receiving at least a first selected current speech frame (CSF) having digitized speech samples;

C) determining for the CSF: LPC coefficients, a prediction error energy, and at least two of: an energy ($E_c$); a log spectral distance (LSD) between the CSF and the CSF's IPSF; and a pitch predictor coefficient ($\beta_c$);

D) utilizing at least two of: $E_c$, LSD, and $\beta_c$, together with the onset condition of the IPSF for assigning a priority for the CSF and for determining an onset condition of the CSF, where an onset condition of the CSF is used for determining the priority of a next frame;

and updating the IPSF onset condition of the memory unit and the IPSF LPC coefficients and prediction error energy of the memory unit by the CSF onset condition and CSF LPC coefficients and prediction error energy; and E) reiterating steps 1(B) through 1(D) until desired selected speech frames have been prioritized.

2. The method of claim 1, wherein:

assigning a priority to the CSF further includes at least one of:

utilizing a set of predetermined energy thresholds $E_1$, $E_2$, and $E_3$;

utilizing a set of LSD thresholds $LSD_1$, $LSD_2$, and $LSD_3$;

utilizing a pitch predictor coefficient threshold $\beta_1$;

and further includes at least one of the sets of steps of:

A) where the IPSF onset condition is ONSET and $LSD > LSD_3$, setting the onset condition for the CSF to NON-ONSET and assigning a high priority (HP) to the CSF;

B) where at least one of:

the IPSF onset condition is NON-ONSET and $LSD \leqq LSD_3$, setting the onset condition for the CSF to NON-ONSET, and determining whether $E_c \geqq E_1$;

C) where $E_c < E_1$, assigning a low priority (LP) to the CSF;

D) where $E_c \geqq E_1$, determining whether $\beta_c > \beta_1$ and whether $E_c > E_2$, and 1) where both $\beta_c > \beta_1$ and $E_c > E_2$, setting the onset condition for the CSF to ONSET and assigning a HP to the CSF;

2) where at least one of:

$$\beta_c \leqq \beta_1 \text{ and } E_c \leqq E_2,$$

determining whether $LSD > LSD_2$ and whether $E_c > E_3$, and one of:

a) where both $LSD > LSD_2$ and $E_c > E_3$, assigning a HP to the CSF;

b) where at least one of:

$$LSD \leqq LSD_2 \text{ and } E_c \leqq E_3,$$

determining whether $LSD < LSD_1$ and whether at least one of two frames immediately preceding the current frame was assigned a HP, and aa) where both $LSD < LSD_1$ and at least one of two frames immediately preceding the CSF was assigned a HP, assigning a LP to the CSF, and bb) where at least one of: $LSD \geqq LSD_1$ and two frames immediately preceding the current frame were both assigned a LP, aaa) assigning a HP to the CSF where the immediately previous frame is assigned a LP, and bbb) assigning a LP to the CSF where the immediately previous speech frame is assigned a HP; and further including, in step 1(D), one of:

where the onset condition of the CSF indicates an onset speech frame, setting the IPSF onset condition in the memory unit to ONSET; and where the onset condition of the CSF indicates a non-onset speech frame, setting the IPSF onset condition in the memory unit to NON-ONSET.

3. The method of claim 2 wherein the onset condition of the CSF is determined by both comparing the pitch prediction coefficient $\beta_c$ of the CSF with the pitch predictor coefficient threshold $\beta_1$ and by comparing the energy $E_c$ with a predetermined threshold $E_2$ such that, typically, where $\beta_c > \beta_1$ and $E_c > E_2$, the CSF is determined to be an onset speech frame and the CSF onset condition is set to ONSET.

4. The method of claim 2 wherein the log spectral distance is determined by determining a mean squared error of cepstral coefficients between the selected current frame (CSF) and the CFS's immediately preceding frame, the cepstral coefficients for a speech frame being determined iteratively from the LPC coefficients and prediction error energy for the CSF.

5. The method of claim 2 wherein the pitch predictor coefficient is determined by a desired method of linear predictive analysis.

6. The method of claim 2 wherein the set of energy thresholds $E_1$, $E_2$, $E_3$, the set of log spectral distance thresholds $LSD_1$, $LSD_2$, $LSD_3$ and pitch predictor coefficient threshold $\beta_1$ are predetermined utilizing training data obtained for a selected application.

7. The method of claim 6 wherein the set of energy thresholds $E_1$, $E_2$, $E_3$, the set of log spectral distance thresholds $LSD_1$, $LSD_2$, $LSD_3$ and pitch predictor coefficient threshold $\beta_1$ are selected such that:

$$E_1<E_2<E_3,$$

$$LSD_1<LSD_3<LSD_2, \text{ and}$$

$$\beta_1<1.$$

8. A method for assigning a priority to a current speech frame (CSF) having digitized speech samples generated by a linear predictive speech coder in a packet-switched communication network, comprising the steps of:

A) initializing to desired settings a memory unit having at least a first memory location (M1) for onset condition storage of an immediately preceding speech frame (IPSF) and a second memory location (M2) for storage of linear predictive coding (LPC) coefficients and linear prediction error energy of the IPSF;

B) receiving the current speech frame (CSF) having digitized speech samples and determining the LPC coefficients and a prediction error energy for the CSF;

C) determining, for the selected CSF, at least two of:

1) an energy ($E_c$) of the selected CSF;

2) a log spectral distance (LSD) between the CSF and the CSF's IPSF utilizing at least the LPC coefficients of the CSF and of the IPSF; and 3) a pitch predictor coefficient ($\beta_c$) for the selected CSF;

D) utilizing at least two of: $E_c$, LSD, and $\beta_c$, and the onset condition of the IPSF for assigning a priority for the selected CSF and for determining an onset condition of the CSF, where an onset condition of the CSF is used for determining the priority of a next frame;

E) utilizing the at least first and second memory locations for storing the onset condition of the CSF, the LPC coefficients and prediction error energy for the CSF, respectively, to provide at least for utilizing same as a next IPSF onset condition, LPC coefficients for the next IPSF, and prediction error energy for the next IPSF, i.e., by utilizing the CSF onset condition and CSF LPC coefficients and prediction error energy, respectively, for processing a next CSF; and F) reiterating steps 8(B) through 8(E) until desired selected speech frames have been prioritized.

9. The method of claim 8, wherein: assigning a priority to the selected current speech frame further includes at least one of:

utilizing a set of predetermined energy thresholds $E_1$, $E_2$, $E_3$ where an energy ($E_c$) of the selected CSF is determined;

utilizing a set of LSD thresholds $LSD_1$, $LSD_2$, $LSD_3$ where a log spectral distance (LSD) between the selected current frame and the CSF's immediately preceding speech frame utilizing at least the LPC coefficients and prediction error energy of the CSF and of the IPSF is determined;

utilizing a pitch predictor coefficient threshold $\beta_1$, respectively, where the pitch predictor coefficient ($\beta_c$) for the selected CSF is determined; and also further includes at least one of the sets of steps of:

A) where the IPSF onset condition is ONSET and $LSD>LSD_3$, setting the onset condition for the CSF to NON-ONSET and assigning a high priority (HP) to the CSF;

B) where at least one of:

the IPSF onset condition is NON-ONSET and $LSD\leqq LSD_3$, setting the onset condition for the CSF to NON-ONSET, and determining whether $E_c>E_1$;

C) where $E_c<E_1$, assigning a low priority (LP) to the CSF;

D) where $E_c>E_1$, determining whether $\beta_c>\beta_1$ and whether $E_c>E_2$, and 1) where both $\beta_c>\beta_1$ and $E_c>E_2$, setting the onset condition for the CSF to ONSET and assigning a HP to the CSF;

2) where at least one of:

$$\beta_c\leqq\beta_1 \text{ and } E_c\leqq E_2,$$

determining whether $LSD>LSD_2$ and whether $E_c>E_3$, and one of:

a) where both $LSD>LSD_2$ and $E_c>E_3$, assigning a HP to the CSF;

b) where at least one of:

$$LSD\leqq LSD_2 \text{ and } E_c\leqq E_3,$$

determining whether $LSD<LSD_1$ and whether at least one of two frames immediately preceding the current frame was assigned a HP, and aa) where both $LSD<LSD_1$ and at least one of two frames immediately preceding the CSF was assigned a HP, assigning a LP to the CSF, and bb) where at least one of: $LSD>LSD_1$ and two frames immediately preceding the current frame were both assigned a LP, aaa) assigning a HP to the CSF where the immediately previous frame is assigned a LP, and bbb) assigning a LP to the CSF where the immediately previous speech frame is assigned a HP; and further including, in step 8(E), one of:

where the onset condition of the CSF indicates an onset speech frame, setting the IPSF onset condition in the first memory location to ONSET; and where the onset condition of the CSF indicates a non-onset speech frame, setting the IPSF onset condition in the first memory location to NON-ONSET.

10. The method of claim 9 wherein at least one of:

(A) the onset condition of the CSF is determined by both comparing the pitch prediction coefficient $\beta_c$ of the CSF with the pitch predictor coefficient threshold $\beta_1$ and by comparing the energy $E_c$ with a predetermined threshold $E_2$ such that, typically, where $\beta_c>\beta_1$ and $E_c>E_2$, the CSF is determined to be an onset speech frame and the CSF onset condition is set to ONSET;

(B) the log spectral distance is determined by determining a mean squared error of cepstral coefficients between the selected current frame and the CSF's immediately preceding frame, the cepstral coefficients for a speech frame being determined iteratively from the LPC coefficients and prediction error energy for the CSF;

(C) the pitch predictor coefficient is determined by a desired method of linear predictive analysis;

(D) the set of energy thresholds $E_1$, $E_2$, $E_3$, the set of log spectral distance thresholds $LSD_1$, $LSD_2$, $LSD_3$ and pitch predictor coefficient threshold $\beta_1$ are predetermined utilizing training data obtained for a selected application; and (E) the set of energy thresholds $E_1$, $E_2$, $E_3$, the set of log spectral distance thresholds $LSD_1$, $LSD_2$, $LSD_3$ and pitch predictor coefficient threshold $\beta_1$ are selected such that:

$$E_1 < E_2 < E_3,$$

$$LSD_1 < LSD_3 < LSD_2,$$

and $$\beta_1 > 1.$$

11. A method for assigning a priority to a current speech frame (CSF) generated by a linear predictive speech coder in a packet-switched communication network, comprising the steps of:

A) initializing to desired settings a memory unit for storing an onset condition of, and for storing linear predictive coding (LPC) coefficients and linear prediction error energy for, an immediate preceding speech frame (IPSF);

B) receiving the CSF having digitized speech samples and determining the LPC coefficients and a prediction error energy for the CSF;

C) determining for the CSF: an energy ($E_c$), a log spectral distance (LSD) between the CSF and the IPSF, and a pitch predictor coefficient ($\beta_c$);

D) utilizing the $E_c$, LSD, and $\beta_c$ together with the onset condition for assigning a priority for the CSF, determining an onset condition for the CSF where an onset condition of the CSF is used for determining the priority of a next frame, updating the IPSF onset condition, updating the IPSF LPC coefficients, and updating the IPSF prediction error energy by utilizing the CSF onset condition and CSF LPC coefficients and prediction error energy; and E) reiterating steps 11(B) through 11(D) until desired CSFs have been prioritized.

12. The method of claim 11, wherein:

assigning a priority to the selected current speech frame further includes:

utilizing a set of predetermined energy thresholds $E_1$, $E_2$, $E_3$ where an energy ($E_c$) of the selected CSF is determined;

utilizing a set of LSD thresholds $LSD_1$, $LSD_2$, $LSD_3$ where a log spectral distance (LSD) between the selected current frame and its immediately preceding speech frame utilizing at least the LPC coefficients and prediction error energy of the CSF and of the IPSF is determined;

utilizing a pitch predictor coefficient threshold $\beta_1$, respectively, where the pitch predictor coefficient ($\beta_c$) for the selected CSF is determined; and includes at least one of the sets of steps of:

A) where the IPSF onset condition is ONSET and $LSD > LSD_3$, setting the onset condition for the CSF to NON-ONSET and assigning a high priority (HP) to the CSF;

B) where at least one of:

the IPSF onset condition is NON-ONSET and $LSD \leqq LSD_3$, setting the onset condition for the CSF to NON-ONSET, and determining whether $E_c \geqq E_1$;

C) where $E_c < E_1$, assigning a low priority (LP) to the CSF;

D) where $E_c \geqq E_1$, determining whether $\beta_c > \beta_1$ and whether $E_c > E_2$, and 1) where both $\beta_c > \beta_1$ and $E_c > E_2$, setting the onset condition for the CSF to ONSET and assigning a HP to the CSF;

2) where at least one of:

$$\beta_c \leqq \beta_1 \text{ and } E_c \leqq E_2,$$

determining whether $LSD > LSD_2$ and whether $E_c \leqq E_3$, and one of:

a) where both $LSD > LSD_2$ and $E_c > E_3$, assigning a HP to the CSF;

b) where at least one of:

$$LSD \leqq LSD_2 \text{ and } E_c \leqq E_3,$$

determining whether $LSD < LSD_1$ and whether at least one of two frames immediately preceding the current frame was assigned a HP, and aa) where both $LSD < LSD_1$ and at least one of two frames immediately preceding the CSF was assigned a HP, assigning a LP to the CSF, and bb) where at least one of: $LSD \geqq LSD_1$ and two frames immediately preceding the current frame were both assigned a LP, aaa) assigning a HP to the CSF where the immediately previous frame is assigned a LP, and bbb) assigning a LP to the CSF where the immediately previous speech frame is assigned a HP; and further including, in step 11(D), one of:

where the onset condition of the CSF indicates an onset speech frame, setting the IPSF onset condition in the first memory location to ONSET; and where the onset condition of the CSF indicates a non-onset speech frame, setting the IPSF onset condition in the first memory location to NON-ONSET.

13. The method of claim 12 wherein at least one of:

(A) the onset condition of the CSF is determined by both comparing the pitch prediction coefficient $\beta_c$ of the CSF with the pitch predictor coefficient threshold $\beta_1$ and by comparing the energy $E_c$ with a predetermined threshold $E_2$ such that, typically, where $\beta_c > \beta_1$ and $E_c > E_2$, the CSF is determined to be an onset speech frame and the CSF onset condition is set to ONSET;

(B) the log spectral distance is determined by determining a mean squared error of cepstral coefficients between the selected current frame and the CSF's immediately preceding frame, the cepstral coefficients for a speech frame being determined iteratively from the LPC coefficients and prediction error energy for the CSF;

(C) the pitch predictor coefficient is determined by a desired method of linear predictive analysis;

(D) the set of energy thresholds $E_1$, $E_2$, $E_3$, the set of log spectral distance thresholds $LSD_1$, $LSD_2$, $LSD_3$ and pitch predictor coefficient threshold $\beta_1$ are predetermined utilizing training data obtained for a selected application; and (E) the set of energy thresholds $E_1$, $E_2$, $E_3$, the set of log spectral distance thresholds $LSD_1$, $LSD_2$, $LSD_3$ and pitch predictor coefficient threshold $\beta_1$ are selected such that:

$$E_1<E_2<E_3,$$

$$LSD_1<LSD_3<LSD_2,$$

and $$\beta_1>1.$$

14. A device for assigning a priority to each of selected speech frames having digitized speech samples generated by a linear predictive speech coder in a packet-switched communication network, having an initializing means comprising at least memory means for storing an onset condition, linear predictive coding (LPC) coefficients, and LPC prediction error energy, respectively, of an immediately preceding speech frame (IPSF), initialized to desired settings upon beginning prioritization, comprising at least:

A) receiving means, operably coupled to receive at least a first selected current speech frame (CSF) having digitized speech samples;

B) determining means, operably coupled to the receiving means, for determining LPC coefficients and a LPC prediction error energy, and for determining, for the CSF, at least two of: an energy ($E_c$); a log spectral distance (LSD) between the CSF and its immediately preceding speech frame (IPSF); and a pitch predictor coefficient ($\beta_c$);

C) prioritizing means, operably coupled to the memory unit and to the determining means, for utilizing at least two of: $E_c$, LSD, and $\beta_c$, together with the onset condition of the IPSF for assigning a priority for the CSF and for determining an onset condition of the CSF and for updating the IPSF onset condition of the memory unit, the IPSF LPC coefficients, and the prediction error energy of the memory unit; and D) iteration means, operably coupled to the prioritizing means, for, where further desired speech frames are desired to be prioritized, recycling to the receiving means.

15. The device of claim 14, wherein:

the prioritizing means for assigning a priority to the selected current speech frame further includes a threshold utilization unit for:

utilizing a set of predetermined energy thresholds $E_1$, $E_2$, $E_3$ where an energy ($E_c$) of the selected CSF is determined;

utilizing a set of LSD thresholds $LSD_1$, $LSD_2$, $LSD_3$ where a log spectral distance (LSD) between the selected current frame and its immediately preceding speech frame utilizing at least the LPC coefficients and prediction error energy of the CSF and of the IPSF is determined;

utilizing a pitch predictor coefficient threshold $\beta_1$, respectively, where the pitch predictor coefficient ($\beta_c$) for the selected CSF is determined;

and further, wherein the prioritizing means is utilized for at least one of:

A) where the IPSF onset condition is ONSET and $LSD>LSD_3$, setting the onset condition for the CSF to NON-ONSET and assigning a high priority (HP) to the CSF;

B) where at least one of:

the IPSF onset condition is NON-ONSET and $LSD\leqq LSD_3$, setting the onset condition for the CSF to NON-ONSET, and determining whether $E_c\geqq E_1$;

C) where $E_c<E_1$, assigning a low priority (LP) to the CSF;

D) where $E_c\geqq E_1$, determining whether $\beta_c>\beta_1$ and whether $E_c>E_2$, and 1) where both $\beta_c>\beta_1$ and $E_c>E_2$, setting the onset condition for the CSF to ONSET and assigning a HP to the CSF;

2) where at least one of:

$$\beta_c\leqq\beta_1 \text{ and } E_c\leqq E_2,$$

determining whether $LSD>LSD_2$ and whether $E_c>E_3$, and one of:

a) where both $LSD>LSD_2$ and $E_c>E_3$, assigning a HP to the CSF;

b) where at least one of:

$$LSD\leqq LSD_2 \text{ and } E_c\leqq E_3,$$

determining whether $LSD<LSD_1$ and whether at least one of two frames immediately preceding the current frame was assigned a HP, and aa) where both $LSD<LSD_1$ and at least one of two frames immediately preceding the CSF was assigned a HP, assigning a LP to the CSF, and bb) where at least one of: $LSD\geqq LSD_1$ and two frames immediately preceding the current frame were both assigned a LP, aaa) assigning a HP to the CSF where the immediately previous frame is assigned a LP, and bbb) assigning a LP to the CSF where the immediately previous speech frame is assigned a HP;

and further including utilizing the prioritizing means to:

update the IPSF LPC coefficients of the memory unit using the LPC coefficients of the CSF, update the IPSF prediction error energy of the memory unit using the prediction error energy of the CSF, and one of:

where the onset condition of the CSF indicates an onset speech frame, update the IPSF onset condition of the memory unit to ONSET; and where the onset condition of the CSF indicates a non-onset speech frame, update the IPSF onset condition of the memory unit to NON-ONSET.

16. The device of claim 15 wherein the prioritizing means includes at least one of:

(A) an onset condition determining unit, operably coupled to receive $E_c$, $E_2$, $\beta_c$, and $\beta_1$, for determining the onset condition of the CSF by both comparing the pitch prediction coefficient $\beta_c$ of the CSF with the pitch predictor coefficient threshold $\beta_1$ and by comparing the energy $E_c$ with a predetermined threshold $E_2$ such that, typically, where $\beta_c > \beta_1$ and $E_c > E_2$, the CSF is determined to be an onset speech frame and the CSF onset condition is set to ONSET;

(B) a log spectral distance determining unit, operably coupled to receive the LPC coefficients and prediction error energy for the CSF, for substantially determining a mean squared error of cepstral coefficients between the selected current speech frame and its immediately preceding speech frame, the cepstral coefficients for a speech frame being determined iteratively from the LPC coefficients and prediction error energy for the CSF;

(C) the pitch predictor coefficient is determined by a desired method of linear predictive analysis;

(D) the set of energy thresholds $E_1$, $E_2$, $E_3$, the set of log spectral distance thresholds $LSD_1$, $LSD_2$, $LSD_3$ and pitch predictor coefficient threshold $\beta_1$ are predetermined utilizing training data obtained for a selected application; and (E) the set of energy thresholds $E_1$, $E_2$, $E_3$, the set of log spectral distance thresholds $LSD_1$, $LSD_2$, $LSD_3$ and pitch predictor coefficient threshold $\beta_1$ are selected such that:

$$E_1 < E_2 < E_3,$$

$$LSD_1 < LSD_3 < LSD_2,$$

and $$\beta_1 \geqq 1.$$

17. A device for assigning a priority to at least a first current speech frame (CSF) of digitized speech samples generated by a linear predictive speech coder in a packet-switched communication network, comprising at least:

A) initializing means, operably coupled to receive an onset condition, linear predictive coding (LPC) coefficients and linear predictive coding (LPC) prediction error energy for an immediately preceding speech frame (IPSF), for initializing at least a first memory unit to desired settings for the IPSF onset condition, IPSF LPC coefficients and prediction error energy upon beginning prioritization;

B) receiving means, operably coupled to receive the at least first CSF having digitized speech samples;

C) determining means, operably coupled to the receiving means, for determining, for the CSF, LPC coefficients and a prediction error energy and at least two of:

1) an energy ($E_c$) of the selected CSF;

2) a log spectral distance (LSD) between the selected current frame and its immediately preceding speech frame utilizing at least the LPC coefficients of the CSF and of the IPSF; and 3) a pitch predictor coefficient ($\beta_c$);

D) prioritization means, operably coupled to the determining means and to the initializing means, for:

utilizing the at least two of: $E_c$, LSD, and $\beta_c$, and the onset condition of the IPSF for assigning a priority for the CSF and for determining an onset condition of the CSF; and utilizing the at least first memory unit for storing the onset condition of the CSF, the LPC coefficients for the CSF, and the prediction error energy for the CSF, respectively, to provide at least for utilizing same as a next IPSF onset condition, LPC coefficients for the next IPSF, and prediction error energy for the next IPSF, respectively, for processing a next CSF; and E) iteration means, operably coupled to the prioritizing means, for, where further desired speech frames are desired to be prioritized, recycling to the receiving means.

18. The device of claim 17, wherein:

the prioritizing means for assigning a priority to the selected current speech frame further includes a threshold utilization unit for:

utilizing a set of predetermined energy thresholds $E_1$, $E_2$, $E_3$ where an energy ($E_c$) of the selected CSF is determined;

utilizing a set of LSD thresholds $LSD_1$, $LSD_2$, $LSD_3$ where a log spectral distance (LSD) between the selected current frame and its immediately preceding speech frame utilizing at least the LPC coefficients and prediction error energy of the CSF and of the IPSF is determined; and utilizing a pitch predictor coefficient threshold $\beta_1$, respectively, where the pitch predictor coefficient ($\beta_c$) for the selected CSF is determined;

and further, wherein the prioritizing means is utilized for at least one of:

A) where the IPSF onset condition is ONSET and $LSD > LSD_3$, setting the onset condition for the CSF to NON-ONSET and assigning a high priority (HP) to the CSF;

B) where at least one of:

the IPSF onset condition is NON-ONSET and $LSD \leqq LSD_3$, setting the onset condition for the CSF to NON-ONSET, and determining whether $E_c \geqq E_1$;

C) where $E_c < E_1$, assigning a low priority (LP) to the CSF;

D) where $E_c \geqq E_1$, determining whether $\beta_c > \beta_1$ and whether $E_c > E_2$, and 1) where both $\beta_c > \beta_1$ and $E_c > E_2$, setting the onset condition for the CSF to ONSET and assigning a HP to the CSF;

2) where at least one of:

$$\beta_c \leqq \beta_1 \text{ and } E_c \leqq E_2,$$

determining whether $LSD > LSD_2$ and whether $E_c > E_3$, and one of:

a) where both $LSD > LSD_2$ and $E_c > E_3$, assigning a HP to the CSF;

b) where at least one of:

$$LSD \leqq LSD_2 \text{ and } E_c \leqq E_3,$$

determining whether $LSD < LSD_1$ and whether at least one of two frames immediately preceding the current frame was assigned a HP, and aa) where both $LSD < LSD_1$ and at least one of two frames immediately preceding the CSF was assigned a HP, assigning a LP to the CSF, and bb) where at least one of: $LSD \geqq LSD_1$ and two frames immediately preceding the current frame were both a LP, aaa) assigning a HP to the CSF where the immediately previous frame is assigned a LP, and bbb) assigning a LP to the CSF where the immediately previous speech frame is assigned a HP;

and further wherein the prioritizing means is utilized to:

update the memory unit for the IPSF LPC coefficients using the linear predictive (LPC) coefficients of the CSF, update the memory unit for the IPSF prediction error energy, and one of:

where the onset condition of the CSF indicates an onset speech frame, update the memory unit for the IPSF onset condition to ONSET; and where the onset condition of the CSF indicates a non-onset speech frame, update the memory unit for the IPSF onset condition to NON-ONSET.

19. The device of claim 18 wherein the prioritization unit includes at least one of:

(A) an onset condition determining unit, operably coupled to receive $E_c$, $E_2$, $\beta_c$, and $\beta_1$, for determining the onset condition of the CSF by both comparing the pitch prediction coefficient $\beta_c$ of the CSF with the pitch predictor coefficient threshold $\beta_1$ and by comparing the energy $E_c$ with a predetermined threshold $E_2$ such that, typically, where $\beta_c > \beta_1$ and $E_c > E_2$, the CSF is determined to be an onset speech frame and the CSF onset condition is set to ONSET;

(B) a log spectral distance determining unit, operably coupled to received the LPC coefficients and prediction error energy for the CSF, for determining a mean squared error of cepstral coefficients between the selected current frame and its immediately preceding frame, the cepstral coefficients for a speech frame being determined iteratively from the LPC coefficients and prediction error energy for the CSF; and (C) a pitch predictor coefficient determining unit, operably coupled to receive the digitized speech sample, for determining the pitch predictor coefficient by a desired method of linear predictive analysis; wherein:

the set of energy thresholds $E_1$, $E_2$, $E_3$, the set of log spectral distance thresholds $LSD_1$, $LSD_2$, $LSD_3$ and pitch predictor coefficient threshold $\beta_1$ are predetermined utilizing training data obtained for a selected application; and the set of energy thresholds $E_1$, $E_2$, $E_3$, the set of log spectral distance thresholds $LSD_1$, $LSD_2$, $LSD_3$ and pitch predictor coefficient threshold $\beta_1$ are selected such that:

$$E_1 < E_2 < E_3,$$

$$LSD_1 < LSD_3 < LSD_2,$$

and $$\beta_1 \geqq 1.$$

20. A device for assigning a priority to at least a first current speech frame (CSF) of digitized speech samples generated by a linear predictive speech coder in a packet-switched communication network, having an initializing means comprising at least memory means for storing an onset condition, linear predictive coding (LPC) coefficients and prediction error energy, respectively, of an immediately preceding speech frame (IPSF) that are initialized to desired settings upon beginning prioritization, and further comprising at least:

A) receiving means, operably coupled to receive the at least first CSF having the digitized speech samples;

B) determining means, operably coupled to the receiving means, for determining LPC coefficients and a prediction error energy for the CSF, and for determining, for the CSF: an energy ($E_c$), a log spectral distance (LSD) between the CSF and the IPSF, and a pitch predictor coefficient ($\beta_c$);

C) prioritizing means, operably coupled to the memory unit and to the determining means, for utilizing the $E_c$, LSD, and $\beta_c$ together with the IPSF onset condition for assigning a priority for the CSF, determining an onset condition for the CSF, and for updating the IPSF onset condition of the memory unit, the IPSF LPC coefficients and the IPSF prediction error energy of the memory unit; and D) iterating means, operably coupled to the prioritizing means, for, where further desired speech frames are desired to be prioritized, recycling to the receiving means.

21. The device of claim 20, wherein:

the prioritizing means for assigning a priority to the selected current speech frame further includes a threshold utilization unit for:

utilizing a set of predetermined energy thresholds $E_1$, $E_2$, $E_3$ where an energy ($E_c$) of the selected CSF is determined;

utilizing a set of LSD thresholds $LSD_1$, $LSD_2$, $LSD_3$ where a log spectral distance (LSD) between the selected current frame and its immediately preceding speech frame utilizing at least the LPC coefficients and prediction error energy of the CSF and of the IPSF is determined;

utilizing a pitch predictor coefficient threshold $\beta_1$, respectively, where the pitch predictor coefficient ($\beta_c$) for the selected CSF is determined;

and further, wherein the prioritizing means is utilized for at least one of:

A) where the IPSF onset condition is ONSET and $LSD > LSD_3$, setting the onset condition for the CSF to NON-ONSET and assigning a high priority (HP) to the CSF;

B) where at least one of:

the IPSF onset condition is NON-ONSET and $LSD \leqq LSD_3$, setting the onset condition for the CSF to NON-ONSET, and determining whether $E_c \geqq E_1$;

C) where $E_c < E_1$, assigning a low priority (LP) to the CSF;

D) where $E_c \geqq E_1$, determining whether $\beta_c > \beta_1$ and whether $E_c > E_2$, and 1) where both $\beta_c > \beta_1$ and $E_c > E_2$, setting the onset condition for the CSF to ONSET and assigning a HP to the CSF;

2) where at least one of:

$$\beta_c \leqq \beta_1 \text{ and } E_c \leqq E_2,$$

determining whether $LSD > LSD_2$ and whether $E_c > E_3$, and one of:

a) where both $LSD > LSD_2$ and $E_c > E_3$, assigning a HP to the CSF;

b) where at least one of:

$$LSD \leqq LSD_2 \text{ and } E_c \leqq E_3,$$

determining whether $LSD < LSD_1$ and whether at least one of two frames immediately preceding the current frame was assigned a HP, and aa) where both $LSD < LSD_1$ and at least one of two frames immediately preceding the CSF was assigned a HP, assigning a LP to the CSF, and bb) where at least one of: $LSD \geqq LSD_1$ and two frames immediately preceding the current frame were both assigned a LP, aaa) assigning a HP to the CSF where the immediately previous frame is assigned a LP, and bbb) assigning a LP to the CSF where the immediately previous speech frame is assigned a HP;

and further wherein the prioritizing means is utilized to:

update the IPSF linear predictive (LPC) coefficients of the memory unit using the linear predictive (LPC) coefficients of the CSF, update the IPSF prediction error energy of the memory unit using the prediction error energy of the CSF, and one of:

where the onset condition of the CSF indicates an onset speech frame, update the IPSF onset condition of the memory unit to ONSET; and where the onset condition of the CSF indicates a non-onset speech frame, update the IPSF onset condition of the memory unit to NON-ONSET.

22. The device of claim 21 wherein at least one of:

(A) the onset condition of the CSF is determined by both comparing the pitch prediction coefficient $\beta_c$ of the CSF with the pitch predictor coefficient threshold $\beta_1$ and by comparing the energy $E_c$ with a predetermined threshold $E_2$ such that, typically, where $\beta_c > \beta_1$ and $E_c > E_2$, the CSF is determined to be an onset speech frame and the CSF onset condition is set to ONSET;

(B) the log spectral distance is determined by determining a mean squared error of cepstral coefficients between the selected current frame and its immediately preceding frame, the cepstral coefficients for a speech frame being determined iteratively from the LPC coefficients and prediction error energy for the CSF;

(C) the pitch predictor coefficient is determined by a desired method of linear predictive analysis;

(D) the set of energy thresholds $E_1$, $E_2$, $E_3$, the set of log spectral distance thresholds $LSD_1$, $LSD_2$, $LSD_3$ and pitch predictor coefficient threshold $\beta_1$ are predetermined utilizing training data obtained for a selected application; and (E) the set of energy thresholds $E_1$, $E_2$, $E_3$, the set of log spectral distance thresholds $LSD_1$, $LSD_2$, $LSD_3$ and pitch predictor coefficient threshold $\beta_1$ are selected such that:

$$E_1 < E_2 < E_3,$$

$$LSD_1 < LSD_3 < LSD_2,$$

and $$\beta_1 \geqq 1.$$

* * * * *

UNITED STATES PATENT AND TRADEMARK OFFICE
CERTIFICATE OF CORRECTION

PATENT NO. : 5,253,326

DATED : October 12, 1993

INVENTOR(S) : Mei Yong

It is certified that error appears in the above-identified patent and that said Letters Patent is hereby corrected as shown below:

In the claims:

At column 9, line 15, "$B_1 < 1$." should be --$B_1 \geq 1$.--.

At column 12, line 23, "$\leq E_3$" should be -- $> E_3$--.

At column 16, line 66, "were both a LP," should be --were both assigned a LP--.

Signed and Sealed this

Sixteenth Day of May, 1995

*Attest:*

*Attesting Officer*

BRUCE LEHMAN

*Commissioner of Patents and Trademarks*